US010480896B2

(12) United States Patent
Jen

(10) Patent No.: US 10,480,896 B2
(45) Date of Patent: Nov. 19, 2019

(54) MULTI-PLATFORM ERGONOMIC FOREGRIP AND ACCESSORY RAIL FOR FIREARMS

(71) Applicant: Strike Industries, Inc., Santa Ana, CA (US)

(72) Inventor: Yi Huei Jen, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 15/852,232

(22) Filed: Dec. 22, 2017

(65) Prior Publication Data

US 2018/0135938 A1 May 17, 2018

Related U.S. Application Data

(63) Continuation-in-part of application No. 14/725,353, filed on May 29, 2015, now abandoned, and a continuation-in-part of application No. 14/675,484, filed on Mar. 31, 2015, now Pat. No. 9,891,020, and a continuation-in-part of application No. 14/529,045, filed on Oct. 30, 2014.

(51) Int. Cl.

| | |
|---|---|
| ***F41G 11/00*** | (2006.01) |
| ***F41C 23/16*** | (2006.01) |
| ***F41C 27/00*** | (2006.01) |

(52) U.S. Cl.

CPC ..... *F41C 23/16* (2013.01); *F41C 27/00* (2013.01); *F41G 11/003* (2013.01)

(58) Field of Classification Search

CPC ..... F41C 23/16; F41C 27/00
USPC ..... 42/90, 124, 127
See application file for complete search history.

(56) References Cited

U.S. PATENT DOCUMENTS

| | | | | |
|---|---|---|---|---|
| 7,836,625 | B2 * | 11/2010 | Swan | F41G 11/003 42/127 |
| 8,925,236 | B1 * | 1/2015 | Mayberry | F41G 11/005 42/124 |
| 9,523,554 | B2 * | 12/2016 | Mayberry | F41C 23/16 |
| 2011/0167703 | A1 * | 7/2011 | Deros | F41G 11/003 42/90 |
| 2016/0091272 | A1 * | 3/2016 | Hines | F41A 35/00 42/90 |

* cited by examiner

*Primary Examiner* — Reginald S Tillman, Jr.
(74) *Attorney, Agent, or Firm* — Andy M. Han; Han IP PLLC

(57) ABSTRACT

A detachable firearm attachment implementable on a firearm may include a main body and a fastening device. The main body may have a first primary side and a second primary side. The first primary side may be configured to attach to both a first handguard rail system of a first handguard of the firearm and a second handguard rail system of a second handguard of the firearm. The fastening device may be configured to fasten the main body to the first handguard and the second handguard. The first handguard may include a plurality of first openings of a first shape with first dimensions. The second handguard may include a plurality of second openings of a second shape with second dimensions. The first shape and the second shape may be different. The first dimensions and the second dimensions may be different.

15 Claims, 11 Drawing Sheets

MULTI-PLATFORM ERGONOMIC FOREGRIP AND ACCESSORY RAIL FOR FIREARMS

CROSS REFERENCE TO RELATED PATENT APPLICATIONS

The present disclosure is part of a continuation-in-part (CIP) application based on, which claims the priority benefit of, U.S. patent application Ser. No. 14/529,045, filed on 30 Oct. 2014, U.S. patent application Ser. No. 14/675,484, filed on 31 Mar. 205, and U.S. patent application Ser. No. 14/725,353, filed on 29 May 2015. Contents of the above-listed applications are herein incorporated by reference in their entirety.

TECHNICAL FIELD

The present disclosure is generally related to firearms and, more particularly, to rail systems for mounting accessories on firearms.

BACKGROUND

Unless otherwise indicated herein, approaches described in this section are not prior art to the claims listed below and are not admitted as prior art by inclusion in this section.

Presently, many shooters utilize different accessories to enhance their firearm and/or to provide additional functionality which allows for improved firearm utilization. One of such accessories is the firearm foregrip. One of the most popular firearm accessories is the foregrip. A firearm foregrip is typically attached onto a handguard via different mechanisms that allow a user to essentially customize his/her firearm. The foregrip provides a stable position on the fore end of the firearm to guide the shooter's support hand as well as to allow the shooter to apply some rearward pressure to the foregrip, thereby allowing the shooter to firmly seat the firearm against his/her shoulder. Fortunately, a user is not limited to one specific design of foregrip, as there are vertical foregrips and angled foregrips, for example, each serving a similar purpose. However, the angled foregrip typically maintains the functionality of the vertical grip while providing additional capability and supporting hand ergonomics. The ergonomic functionality comes from the ability of the angled foregrip to allow a user to properly utilize their support hand, especially for long periods of engagement, without the wrist strain associated with using a vertical foregrip. Therefore, many shooters have a preference to utilize the angled foregrip over the vertical foregrip. In addition to its ergonomic functionality, an angled foregrip allows a shooter to employ different support hand holding techniques.

Nevertheless, an issue which shooters have encountered with the angled foregrip is its ability to be utilized on different handguard mounting platforms. Current foregrip mounting mechanisms utilize a KeyMod mounting mechanism which is a standard mounting platform for mounting accessories onto a handguard of a firearm. A second mounting mechanism, which was recently developed but becoming more popular and heading towards being a standardized mounting platform is the M-LOK platform. The M-LOK platform provides many advantages over previous mounting platforms while maintaining the strength of attachment mechanism. Accordingly, M-LOK is being slowly phased in as the standard platform. Unfortunately, costs and availability of accessories that can mount on the M-LOK platform have caused some shooters to consider the short-term advantages of utilizing an M-LOK platform. On the other hand, some early adopters of the M-LOK platform have found that they cannot utilize their KeyMod mounting accessories with their M-LOK platform. Hence, shooters may need to discard their accessories or sell them to purchase new ones. As previously mentioned, the firearm foregrip is typically one of the most, if not the most, popular accessory for a shooter to add to his/her firearm. Most are made to fit the KeyMod platform, which is good for those still utilizing the old platform, but for those who have adopted to the M-LOK platform it may take a while for accessories to be developed to adapt to the M-LOK platform.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

It is an object of the present disclosure to propose a foregrip that can be attached to the older KeyMod platform as well as the newer M-LOK platform, while still maintaining the strength and stability of the proven KeyMod foregrip designs. Accordingly, the present disclosure describes a multi-platform ergonomic foregrip which can be attached onto different mounting platform handguards. The foregrip may include a base adapted to engage a handguard, a front-end portion, a rear end portion, and an intermediate portion. The front-end portion features two engagement surfaces that are generally vertical in relation to the attachment rail on which it is attached, and can be engage by a user's hand or finger to provide additional firing control. The rear portion features two additional engagement surfaces that also allow a user to utilize different firearm control hand techniques via a partially curved portion and an angled portion. Moreover, the intermediate portion is partially curved and partially horizontal and connected the front end to the rear end. The design of the intermediate section provides maximum ergonomic positioning for a shooters hand to be placed when utilizing different firearm control hand techniques.

It is noteworthy that, although examples provided in the present disclosure may be related to a certain type of firearms (e.g., AR15), various embodiments in accordance with the present disclosure may be adapted or otherwise implemented in different types of firearms. For instance, various embodiments in accordance with the present disclosure may be utilized with semiautomatic pistols, semiautomatic rifles, semiautomatic carbines, bolt-action rifles, as well as other types of firearms. Therefore, the scope of the present disclosure is not limited to examples provided herein.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

Overview

Figure 1:
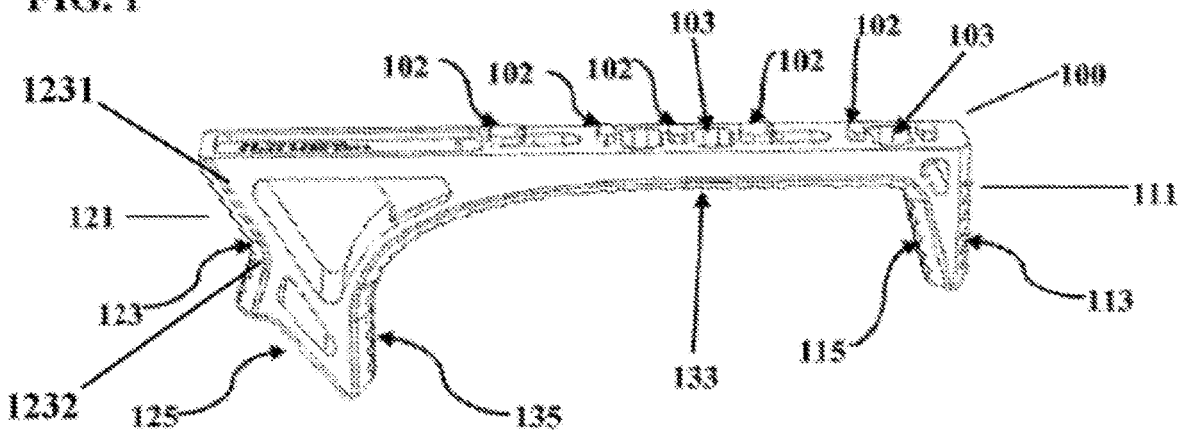
FIG. 1 is an illustration of an embodiment of the present disclosure.
Figure 2:
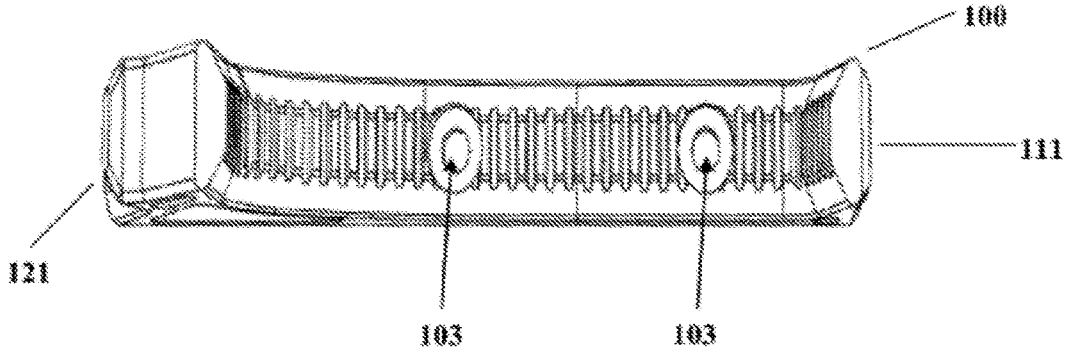
FIG. 2 is a bottom view of an embodiment of the present disclosure.
Figure 3:
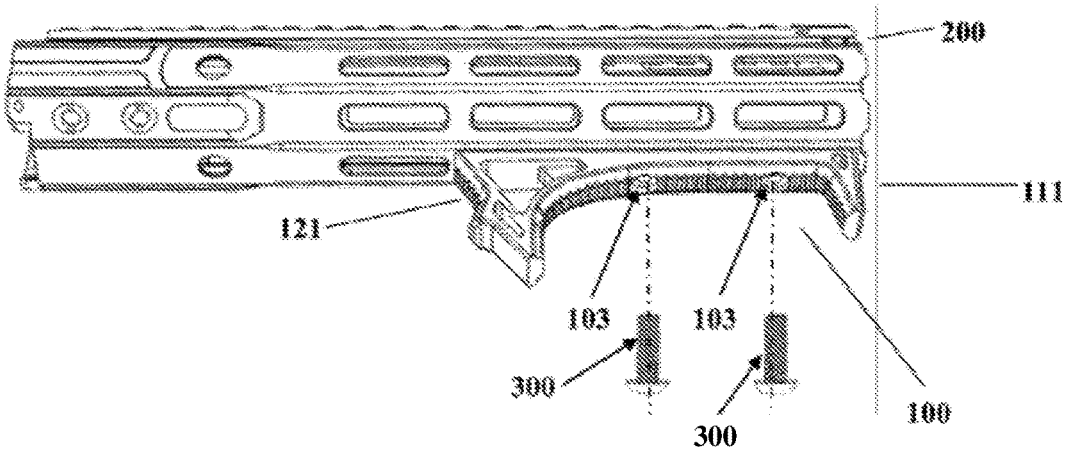
FIG. 3 is an illustration of an embodiment positioned on a firearm handguard in accordance with an implementation of the present disclosure.
Figure 4:
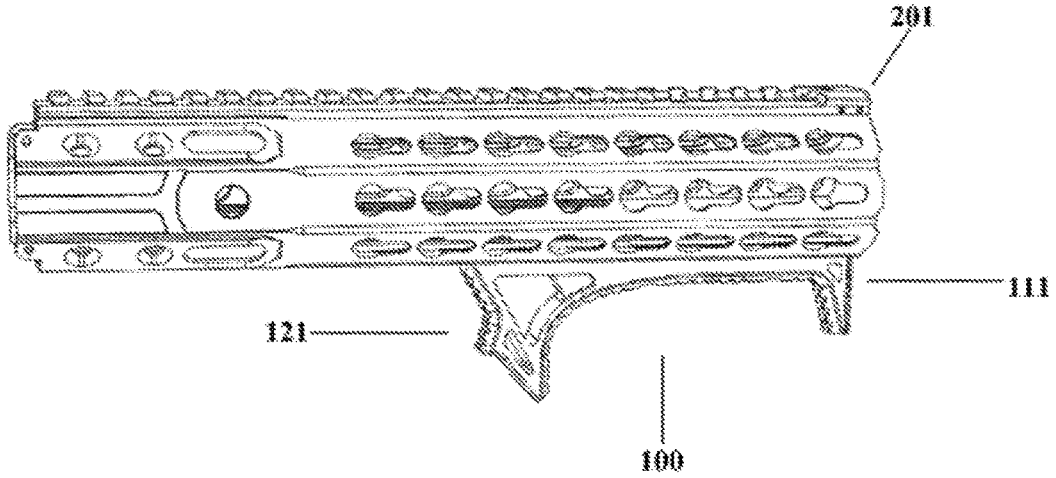
FIG. 4 is an illustration of an embodiment attached on one style of a firearm handguard in accordance with an implementation of the present disclosure.
Figure 5:
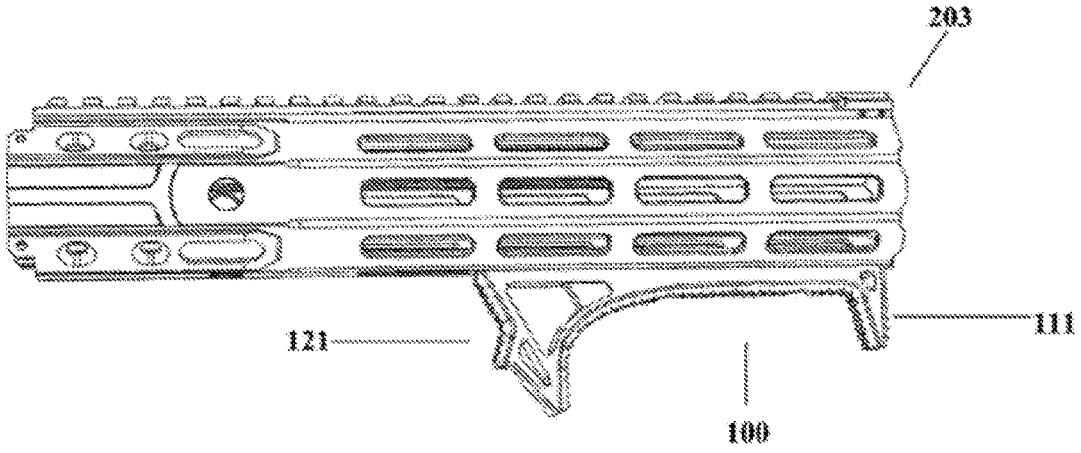
FIG. 5 is an illustration of an embodiment attached on another style of a firearm handguard in accordance with an implementation of the present disclosure.
Figure 6:
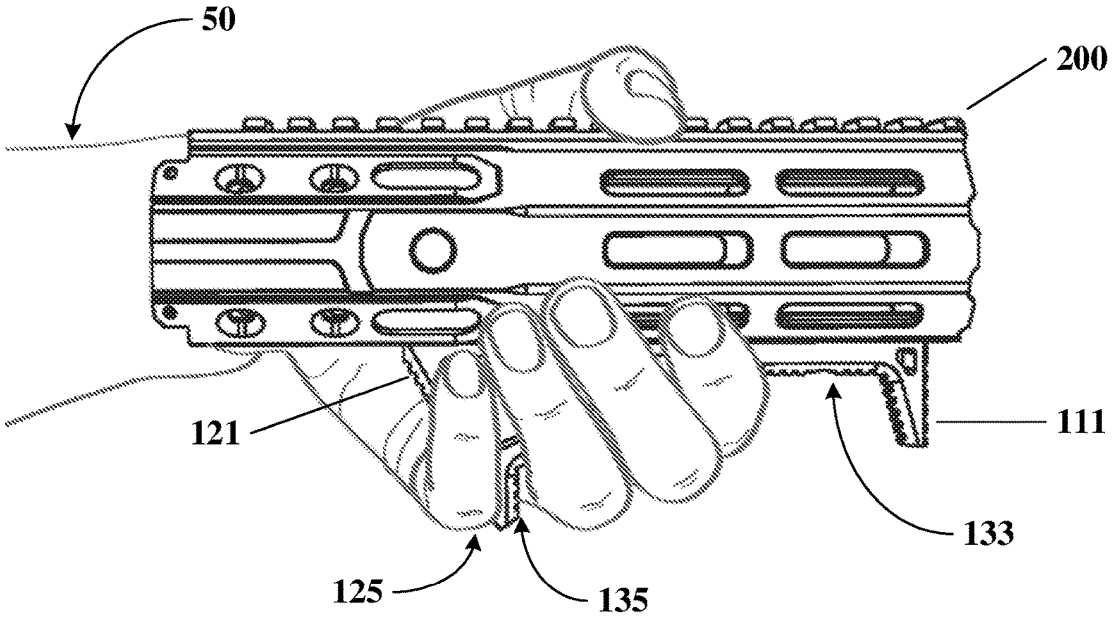
FIGS. 6-9 are illustrations of different methods that an embodiment of the present disclosure can be utilized by a shooter in holding a firearm handguard.

FIG. 1 is an illustration of a multi-platform ergonomic foregrip 100 in accordance with the present disclosure. This illustration shows a plurality of engagement, attachment and positioning features. On the attachment surface of multi-platform ergonomic foregrip 100, positioning lugs 102 are present to guide a user 50 in the installation process. These lugs 102 allows multi-platform ergonomic foregrip 100 to be positioned appropriately, prior to securing the apparatus, on different handguard mounting platforms. This is apparent in FIGS. 4 and 5 which each illustrate different mounting platforms, in this case the KeyMod mounting platform and the M-LOK handguard mounting platform, respectively. Insertion of a fastener 300 via fastener holes 103, shown in FIG. 2, and illustrated in FIG. 3 will provide a method for securing multi-platform ergonomic foregrip 100 onto a firearm handguard 200.

Referring to FIG. 1, multi-platform ergonomic foregrip 100 further features a front end 111 and a rear end 121 separated by a horizontal engagement portion 133, which runs from the front end, and a curved engagement portion 135 which connected the horizontal engagement portion 133 to the rear end 121.

Figure 7:
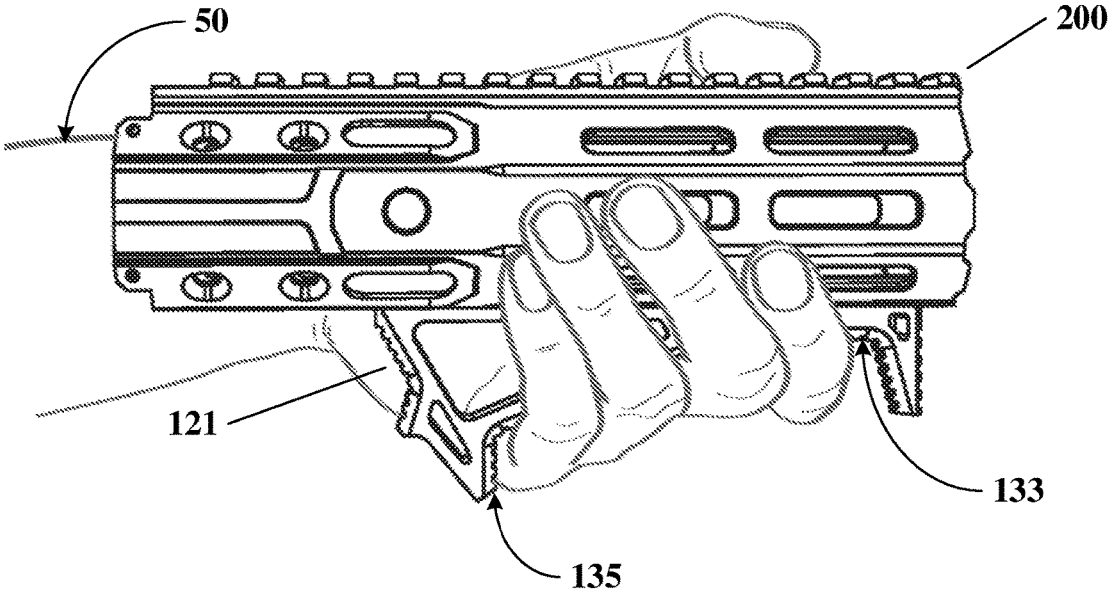
Figure 8:
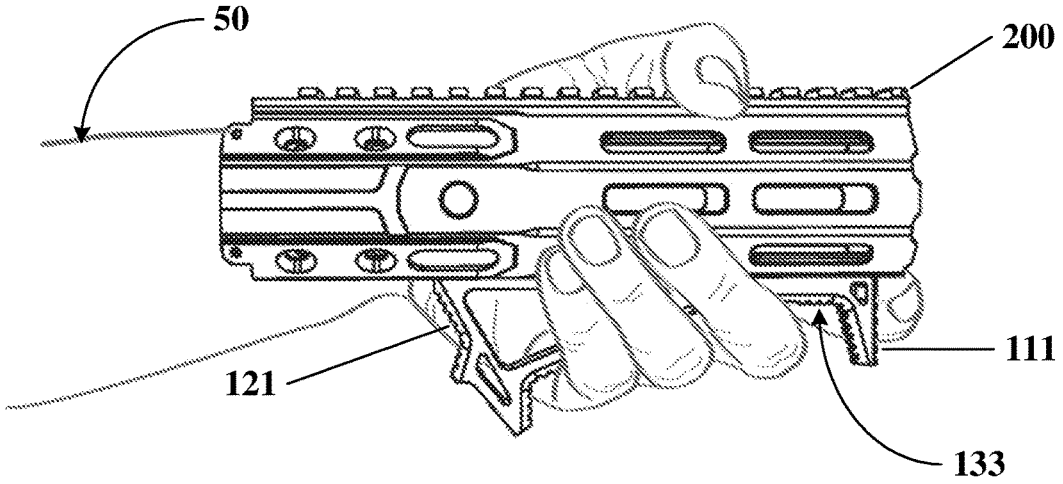
Figure 9:
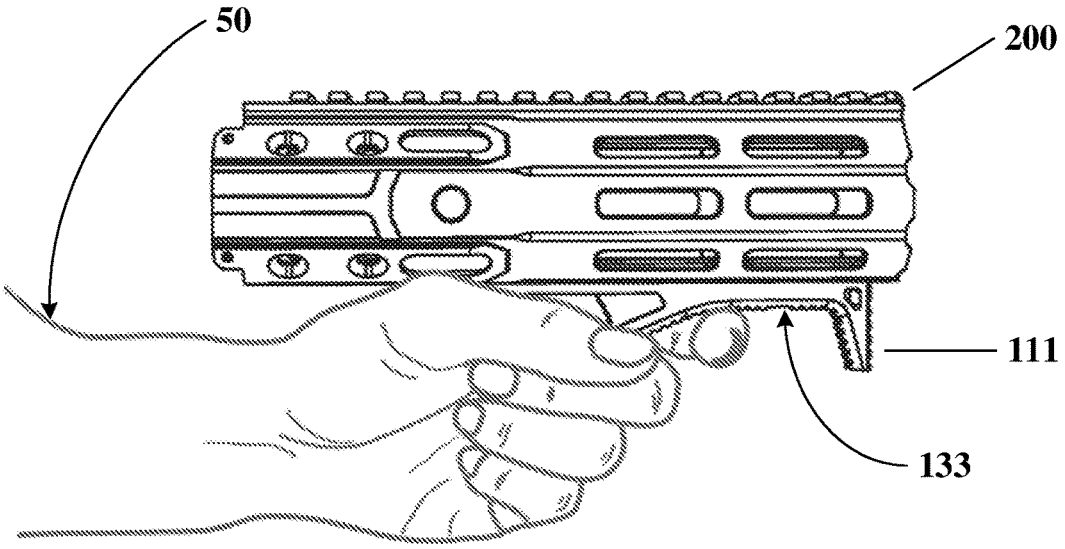

The front end further comprises a vertical member defined by a first vertical engagement surface 113 (herein interchangeably referred as an "outer vertical surface") and a second vertical engagement surface 115 (herein interchangeably referred as an "inner vertical surface") by which a user 50 can utilize in a method similar to that shown in both FIG. 8 and FIG. 9. The rear end 121 further comprises two engagement surfaces wherein a first engagement surface 123, having a first angled grip surface 1231 and a second angled grip surface 1232 connecting at an angle over ninety (90) degrees, provides a position for a user 50 to utilize a method of holding multi-platform ergonomic foregrip 100, as illustrated in FIG. 7. The rear end 121 also features a second engagement surface 125 by which a shooter can position their hand on the handguard. In some embodiments, multi-platform ergonomic foregrip 100 also features the curved engagement portion 135 and the horizontal engagement surface 133 by which a user 50 can effectively position their hand or a finger to provide additional grip and better firing control as shown in FIGS. 6 through 9.

FIGS. 10-15 show the mounting interface either in a disassembled apparatus or interacting with keyhole-shaped openings 410 of the KeyMod handguard rail system and rounded-rectangular openings 420 of the M-LOK handguard rail system. The mounting interface comprises three parts: a multi-platform accessory rail 100A with a top surface 112 and a bottom surface 114 that comprises an array of alignment relief lugs 110, a fastener screw 350, and a pivot fastener nut 360.

Figure 10:
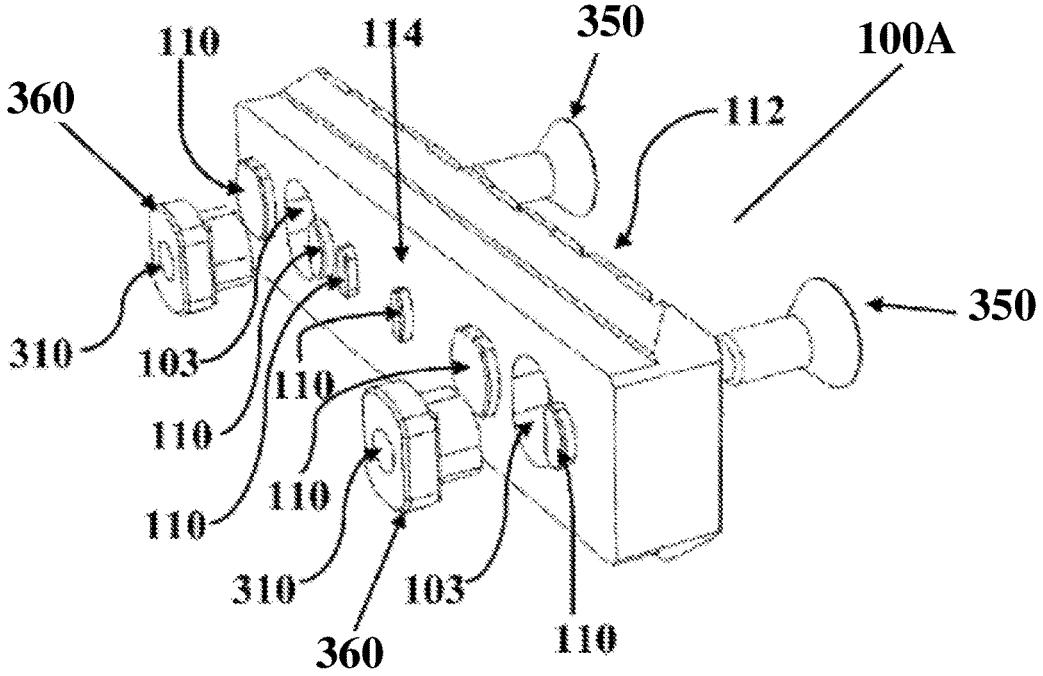
FIG. 10 is an exploded view of an embodiment of the present disclosure.

FIG. 10 shows the components of the mounting interface in an exploded view which shows that insertion of the pivot fastener nut 360 into the fastener hole 103 located on the bottom surface 114 of multi-platform accessory rail 100A will provide a threadably couplable fastener hole 310 by which tightening fastener screw 350 can threadably attach onto through a top surface 112 opening of the fastener hole 103. Fastener screw 350 may be, for example and without limitation, a socket cap screw that has a hexagonal drive hole, a Phillips drive hole, or another type hole. That is, the shape of a drive hole on fastener screw 350 may resemble, for example and without limitation, a hexagon, a cross, a straight line, a six-pointed star, a twelve-pointed star, or a multi-pointed star.

Figure 11:
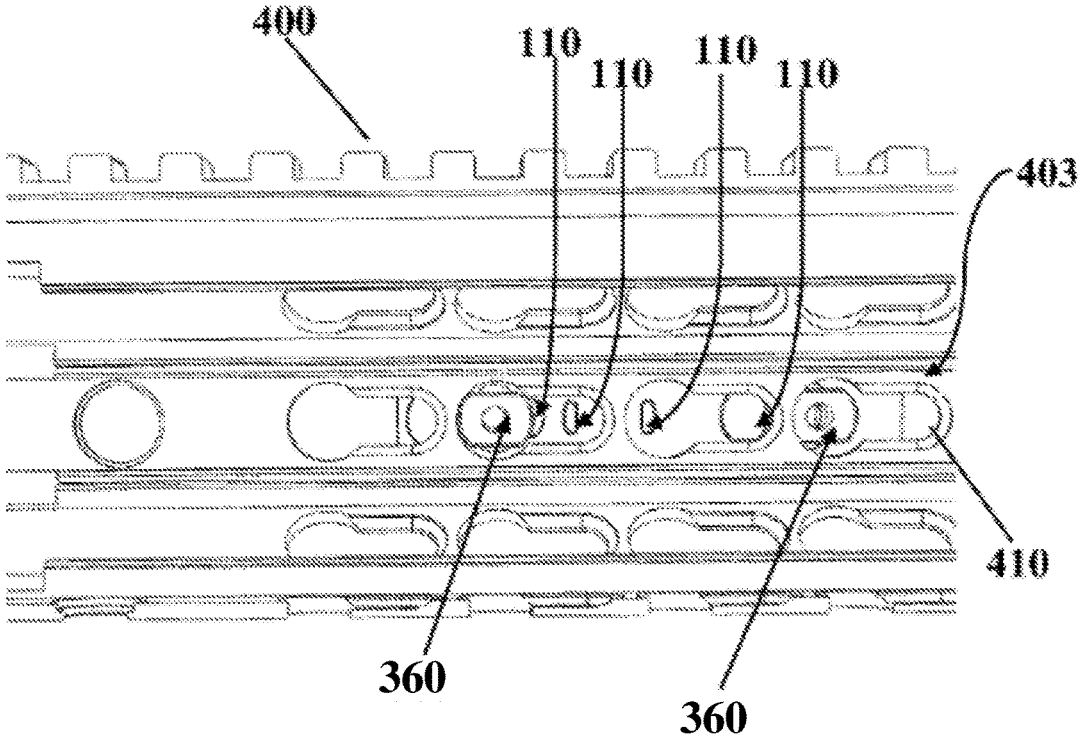
FIG. 11 is a bottom surface view of an embodiment aligned onto cutaway of a firearm handguard rail system in accordance with an implementation of the present disclosure.
Figure 12:
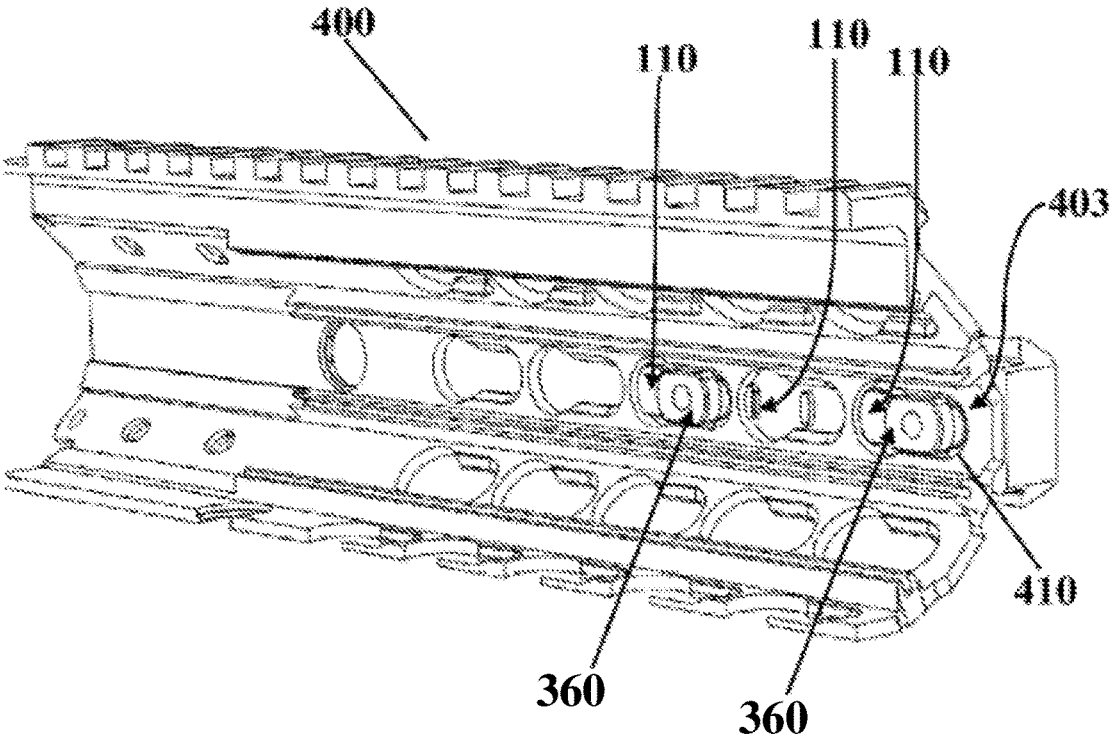
FIG. 12 is a bottom surface view of an embodiment removably coupled onto a firearm handguard rail system in accordance with an implementation of the present disclosure.

FIG. 11 shows the mounting interface aligned onto keyhole-shaped openings 410 of the KeyMod handguard rail system via alignment lugs 110 which physically contact with the rail system and prevents sliding along the rail system. This alignment will mean that the pivot fastener nut 360 can be inserted into the keyhole-shaped openings 410 of the KeyMod handguard rail system. FIG. 12 shows the mounting interface both aligned and locked in place on the keyhole-shaped openings 410 of the KeyMod handguard rail system of the handguard 400 via alignment lugs 110 and pivot fastener nut 360, respectively. Pivot fastener nut 360 engages the inner surface 403 of the handguard 400 by rotating the tightening fastener screw 350 shown in FIG. 10. In some embodiments, alignment lugs 110 may be of the same size and the same shape. Alternatively, alignment lugs 110 may be of different sizes and/or different shapes.

Figure 13:
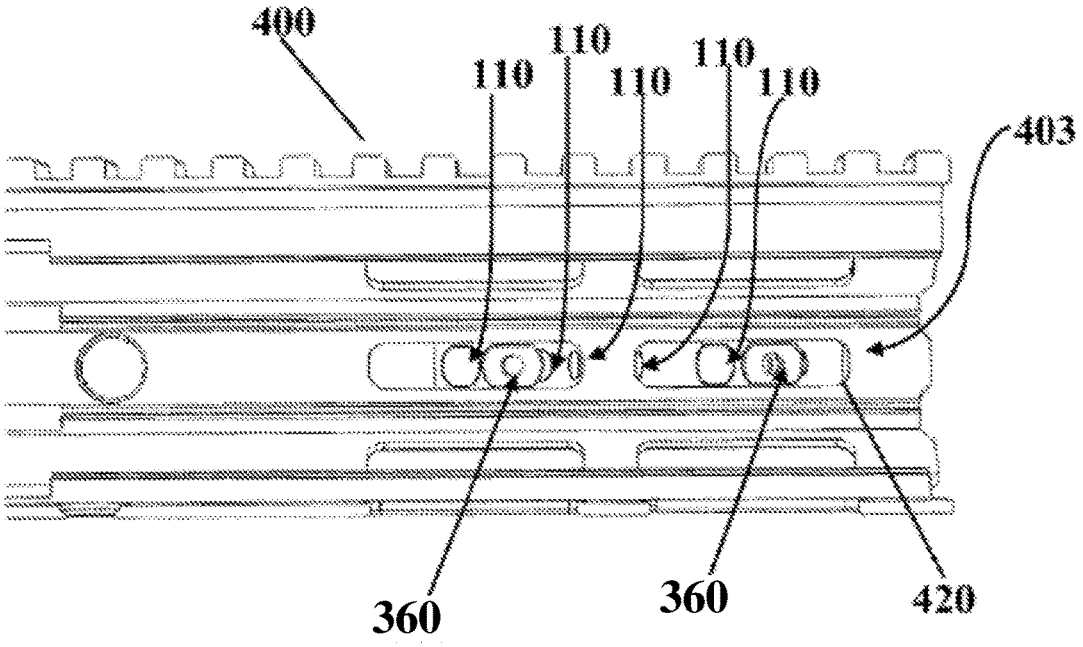
FIG. 13 is a bottom view of an embodiment aligned onto cutaway of a different firearm handguard rail system in accordance with an implementation of the present disclosure.
Figure 14:
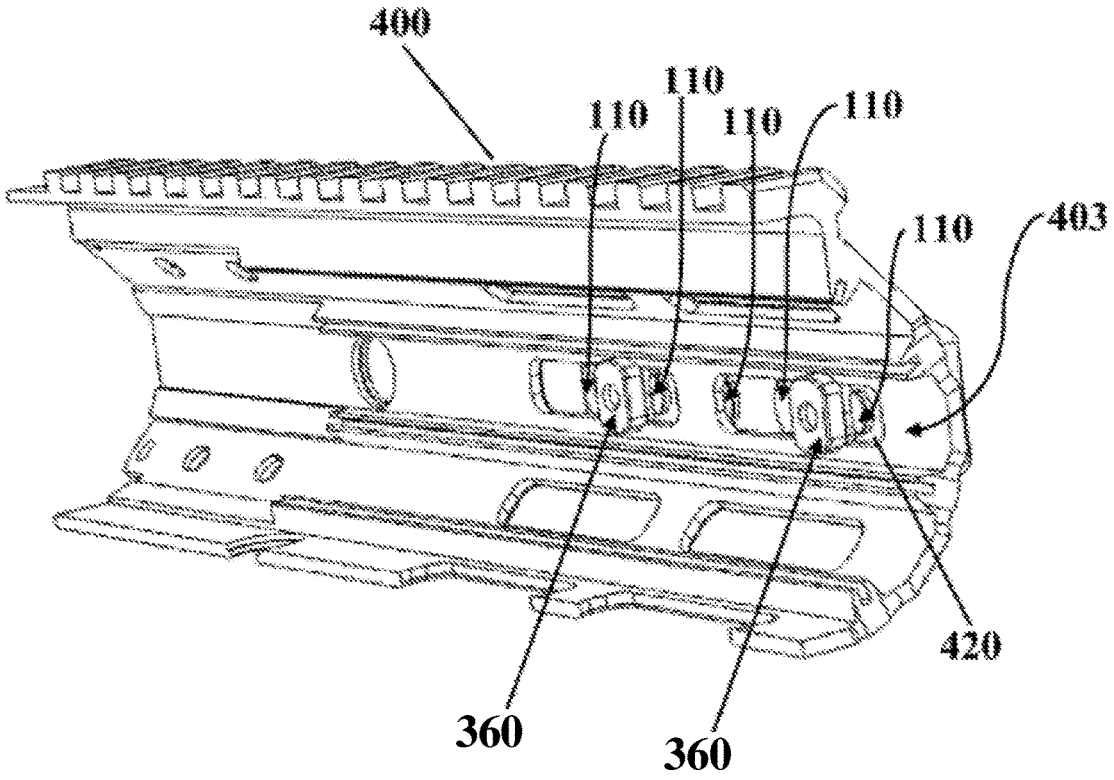
FIG. 14 is a bottom surface view of an embodiment removably coupled onto a firearm handguard rail system in accordance with an implementation of the present disclosure.

FIG. 13 shows the mounting interface aligned onto rounded-rectangular openings 420 of the M-LOK handguard rail system via alignment lugs 110 which physically contact with the rail system and prevents sliding along the rail system. This alignment will mean that the pivot fastener nut 360 can be inserted into the rounded-rectangular openings 420 of the M-LOK handguard rail system. FIG. 14 shows the mounting interface both aligned and locked in place on the keyhole-shaped openings 410 of the KeyMod handguard rail system of the handguard 400 via alignment lugs 110 and pivot fastener nut 360, respectively. Pivot fastener nut 360 engages the handguard 400 by rotating the tightening fastener screw 350 shown in FIG. 10 which in turn rotates the pivot fastener nut 360 such that the pivot fastener nut 360 engages the inner surface 403 of handguard 400.

Figure 15:
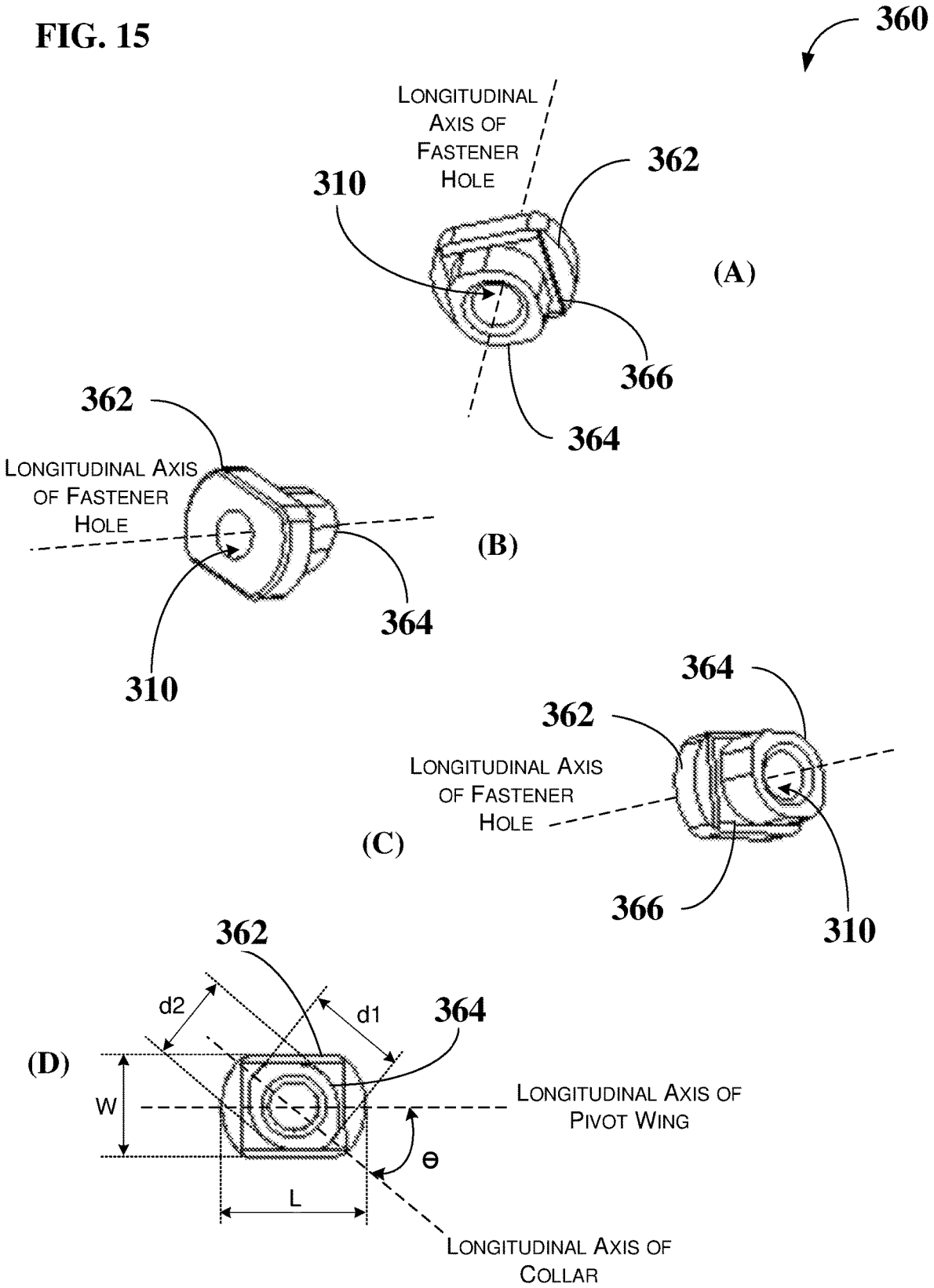
FIG. 15 is an illustration of various views of a fastener component in accordance with an implementation of the present disclosure.

FIG. 15 shows various views of pivot fastener nut 360. Pivot fastener nut 360 may include multiple components such as a threaded fastener through hole 310, a pivot wing 362 and a collar 364. In some alternative embodiments, pivot fastener nut 360 may also include a step portion 366 between pivot wing 362 and collar 364. In the example shown in FIG. 15, pivot wing 362 may be in an elongated shape that generally resembles a rectangle when viewed in a direction along a longitudinal axis of threaded fastener through hole 310. Moreover, in the example shown in FIG. 15, collar 364 may be in a quadrilateral shape that generally resembles a rhombus when viewed in a direction along the longitudinal axis of threaded fastener through hole 310. Furthermore, in the example shown in FIG. 15, step portion 366 may be in a quadrilateral shape that generally resembles a square or rectangle when viewed in a direction along the longitudinal axis of threaded fastener through hole 310.

Referring to parts (A)-(D) of FIG. 15, pivot wing 362 has two long sides that are opposite and parallel to each other and are relatively straight when viewed in a direction along a longitudinal axis of threaded fastener through hole 310. Additionally, referring to parts (A)-(D) of FIG. 15, pivot wing 362 also has two short sides that are opposite to each other and are curved (e.g., convex outwardly) when viewed in a direction along a longitudinal axis of threaded fastener through hole 310. Moreover, referring to part (D) of FIG. 15, an acute angle θ exists between a longitudinal axis of pivot wing 362 (or the generally rectangular shape thereof) and a longitudinal axis of collar 364 (or the generally rhombus shape thereof), and may be in a range between for example and without limitation, 30° and 60°. In some embodiments, the acute angle θ may be 45°. The generally rhombus shape of collar 364, as viewed in a direction along the longitudinal axis of threaded fastener through hole 310, may be considered as having four corners in which two opposing corners have acute angles and the other two opposing corners have obtuse angles or are otherwise rounded. Referring to part (D) of FIG. 15, a distance between the two corners with acute angle may be denoted as d1, and a distance between the two corners with obtuse angle (e.g., the two rounded corners) may be denoted as d2, with d1 greater than d2. Moreover, as shown in part (D) of FIG. 15, a dimension (e.g., length) of pivot wing 362 along the longitudinal axis thereof may be denoted as L, and a dimension (e.g., width) of pivot wing 362 along a direction perpendicular to the longitudinal axis thereof may be denoted as W, with L greater than W.

The dimensions L, W, d1 and d2 of pivot fastener nut 360 are chosen and configured to achieve specific purposes, as explained below.

With respect to keyhole-shaped openings 410 of the KeyMod handguard rail system, dimensions L and W are sufficiently small to allow pivot fastener nut 360 to be inserted through the larger and circular portion of the keyhole-shaped opening 410. Dimensions d1 and d2 are greater than the width of the smaller and narrower portion of the keyhole-shaped opening 410. Thus, with pivot wing 362 of pivot fastener nut 360 inserted through the keyhole-shaped opening 410 and with collar 364 received or otherwise engaged in the smaller and narrower portion of the keyhole-shaped opening 410, the dimension of the smaller and narrower portion of the keyhole-shaped opening 410 prevents collar 364 from turning or rotating. As fastener screw 350 is threaded into fastener hole 310 of pivot fastener nut 360, pivot fastener nut 360 is prevented from turning or rotating. This results in the longitudinal axis of pivot wing 362 remaining parallel to the longitudinal axis of multi-platform accessory rail 100A when fastener screw 350 and pivot fastener nut 360 together fasten or otherwise securely mount multi-platform accessory rail 100A on handguard 400 through some of its keyhole-shaped openings 410.

With respect to rounded-rectangular openings 420 of the M-LOK handguard rail system, dimension W of pivot wing 362 is less than the width of the rounded-rectangular opening 420 while dimension L of pivot wing 362 is greater than the width of the rounded-rectangular opening 420. This allows pivot fastener nut 360 to be inserted through the rounded-rectangular opening 420 in an orientation such that the longitudinal axis of pivot wing 362 is parallel to the longitudinal axis of multi-platform accessory rail 100A. While dimension L is greater than the width of the rounded-rectangular opening 420, dimensions d1, d2 and W are less than the width of the rounded-rectangular opening 420. On the other hand, referring to FIG. 18, fastener hole 103 may be configured as a combination of a larger recess 103B on the bottom surface 114 and a smaller recess 103A on the top surface 112, resulting in a stepwise change in the diameter or width of fastener hole 103 between smaller recess 103A and larger recess 103B. This feature allows collar 364 of pivot fastener nut 360 to be seated, accommodated or otherwise received in the larger recess 103B of fastener hole 103. Moreover, the shape of the larger recess 103B of fastener hole 103 is oblong or rounded-rectangular such that, given dimensions d1 and d2 of collar 364, collar 364 is allowed to turn or rotate in one direction up to 90° when seated, accommodated or otherwise received in the larger recess 103B of fastener hole 103. Thus, as fastener screw 350 is threaded into fastener hole 310 of pivot fastener nut 360, pivot fastener nut 360 is allowed to turn or rotate in one direction up to 90°. This results in the longitudinal axis of pivot wing 362 being perpendicular to the longitudinal axis of multi-platform accessory rail 100A when fastener screw 350 and pivot fastener nut 360 together fasten or otherwise securely mount multi-platform accessory rail 100A on handguard 400 through some of its keyhole-shaped openings 410. Advantageously, with pivot fastener nut 360 turned or rotated by 90°, dimension L of pivot wing 362 prevents pivot wing 362 (and hence pivot fastener nut 360) from slipping out of the rounded-rectangular opening 420, thereby fastening or securely mounting multi-platform accessory rail 100A on handguard 400 through some of its rounded-rectangular opening 420.

Figure 16A:
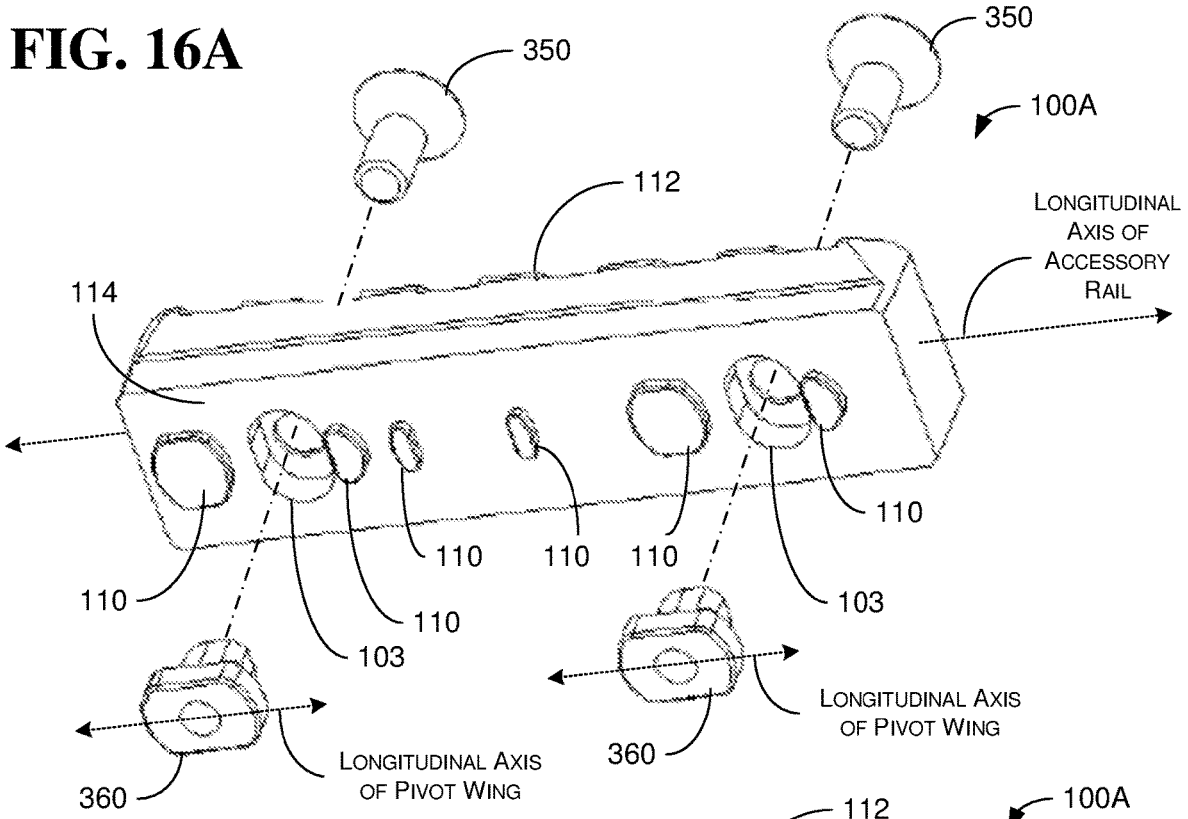
FIG. 16A-FIG. 16C are illustrations of ways of mounting a multi-platform accessory rail for mounting on a first firearm handguard rail system and a second firearm handguard rail system in accordance with an implementation of the present disclosure.
Figure 16B:
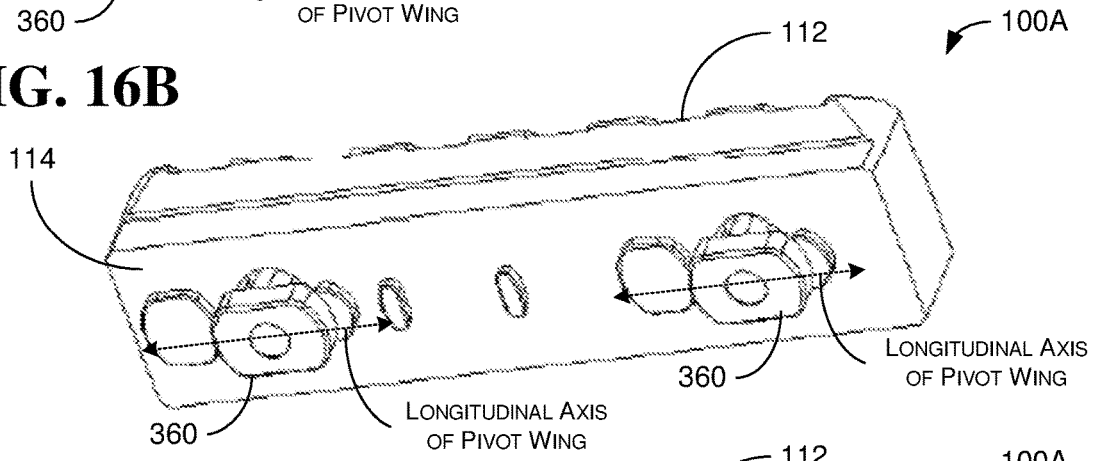
Figure 16C:
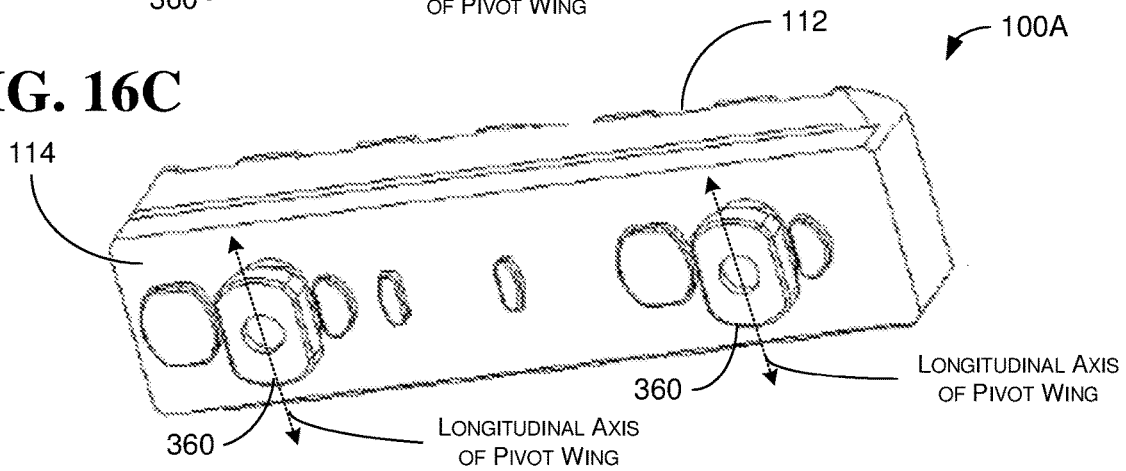

FIG. 16A-FIG. 16C show ways of mounting multi-platform accessory rail 100A for mounting on keyhole-shaped openings 410 of the KeyMod handguard rail system and rounded-rectangular openings 420 of the M-LOK handguard rail system in accordance with an implementation of the present disclosure. It is noteworthy that, in FIG. 16A-FIG. 16C, the handguard 400 (whether having keyhole-shaped openings 410 of the KeyMod handguard rail system or rounded-rectangular openings 420 of the M-LOK handguard rail system) is not shown to avoid obscuring the view of multi-platform accessory rail 100A, fastener screws 350 and pivot fastener nuts 360.

Referring to FIG. 16A, when mounting multi-platform accessory rail 100A on either keyhole-shaped openings 410 of the KeyMod handguard rail system or rounded-rectangular openings 420 of the M-LOK handguard rail system, pivot fastener nuts 360 are oriented in a way such that the longitudinal axis of pivot wing 362 of each pivot fastener nut 360 is parallel to a longitudinal axis of multi-platform accessory rail 100A. This orientation of pivot fastener nuts 360 allows the pivot fastener nuts 360 to be inserted into and through the keyhole-shaped openings 410 as well as the rounded-rectangular openings 420. Specifically, with respect to keyhole-shaped openings 410 of the KeyMod handguard rail system, when oriented as shown in FIG. 16A, the dimensions L and W of pivot wing 362 are sufficiently small to allow pivot fastener nut 360 to be inserted through the larger and circular portion of the keyhole-shaped opening 410. With respect to rounded-rectangular openings 420 of the M-LOK handguard rail system, dimension W of pivot wing 362 is less than the width of the rounded-rectangular opening 420 while dimension L of pivot wing 362 is greater than the width of the rounded-rectangular opening 420. This allows pivot fastener nut 360 to be inserted through the rounded-rectangular opening 420 in the orientation shown in FIG. 16A (i.e., longitudinal axis of pivot wing 362 parallel to longitudinal axis of multi-platform accessory rail 100A).

To fasten or otherwise securely mount multi-platform accessory rail 100A onto handguard 400, each fastener screw 350 is threaded into fastener hole 310 of a corresponding pivot fastener nut 360 by traversing through a corresponding fastener hole 103 (interchangeably referred as fastener hole), from top surface 112 of accessory rail 100A toward bottom surface 114 of multi-platform accessory rail 100A, and a keyhole-shaped opening 410 or a rounded-rectangular opening 420 of handguard 400 (not shown). When mounted on handguard 400, bottom surface 114 of multi-platform accessory rail 100A comes in contact with handguard 400. The alignment lugs 100 are spaced apart such that at least two of the alignment lugs 110 are adjacent to the rim of two distal ends of the same keyhole-shaped or rounded-rectangular opening or different keyhole-shaped or rounded-rectangular openings, thereby eliminating or at least minimizing the amount of linear movement of multi-platform accessory rail 100A (e.g., by sliding linearly) when mounted on handguard 400.

Referring to FIG. 16B, when mounted on keyhole-shaped openings 410 of the KeyMod handguard rail system, collar 364 of each pivot fastener nut 360 may be received in the constricted or narrow portion of the keyhole-shaped opening. Due to the generally rhombus shape of collar 364, collar 364 is prevented from turning or rotating due to physical contact with the constricted or narrow portion of the keyhole-shaped opening. Correspondingly, pivot fastener nut 360 is prevented from turning or rotating as the corresponding fastener screw 350 is fastened into the fastener hole 310 of pivot fastener nut 360. As a result, when multi-platform accessory rail 100A is securely mounted on handguard 400, the longitudinal axis of pivot wing 362 of each pivot fastener nut 360 remains parallel to a longitudinal axis of multi-platform accessory rail 100A.

Referring to FIG. 16C, when mounted on rounded-rectangular openings 420 of the M-LOK handguard rail system, collar 364 of each pivot fastener nut 360 may be received in the constant-width slot of the rounded-rectangular opening. Due to the generally rhombus shape of collar 364, collar 364 is allowed to turn or rotate in one direction up to 90° since the dimension d1 is greater than the width of the slot of the rounded-rectangular opening and since the dimension d2 is less than the width of the slot of the rounded-rectangular opening. Correspondingly, pivot fastener nut 360 turns or rotates 90° as the corresponding fastener screw 350 is fastened into the fastener hole 310 of pivot fastener nut 360. As a result, when multi-platform accessory rail 100A is securely mounted on handguard 400, the longitudinal axis of pivot wing 362 of each pivot fastener nut 360 becomes perpendicular with respect to the longitudinal axis of multi-platform accessory rail 100A.

Figure 17A:
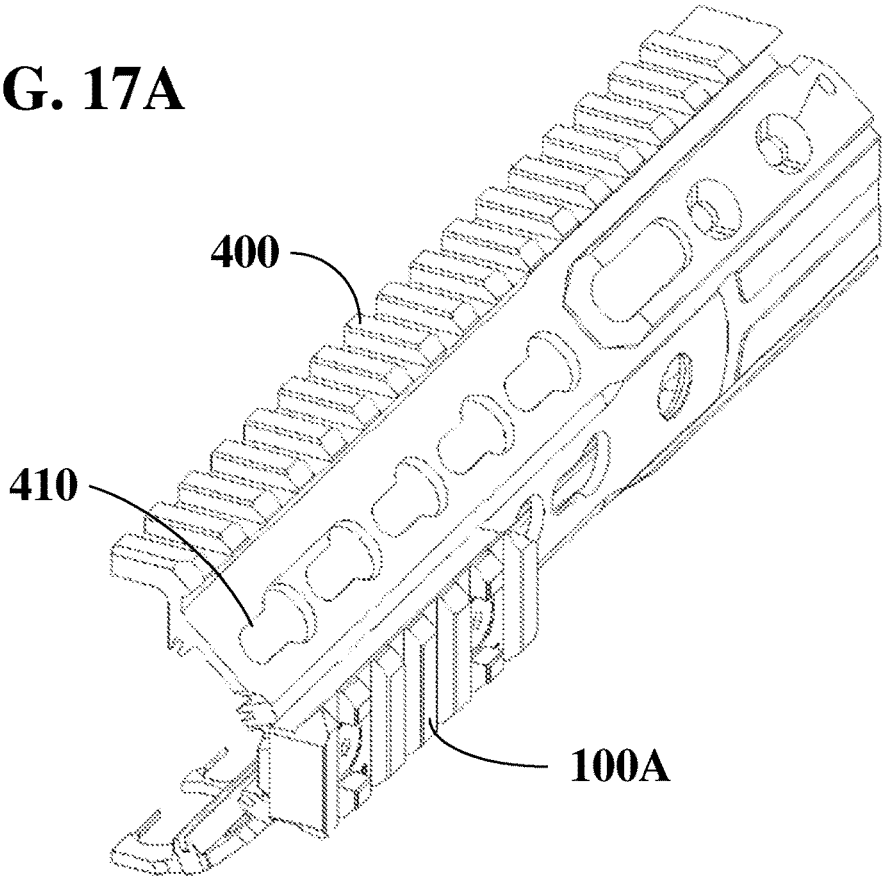
FIG. 17A and FIG. 17B are illustrations of a multi-platform accessory rail mounted on a first firearm handguard rail system and a second firearm handguard rail system in accordance with an implementation of the present disclosure.
Figure 17B:
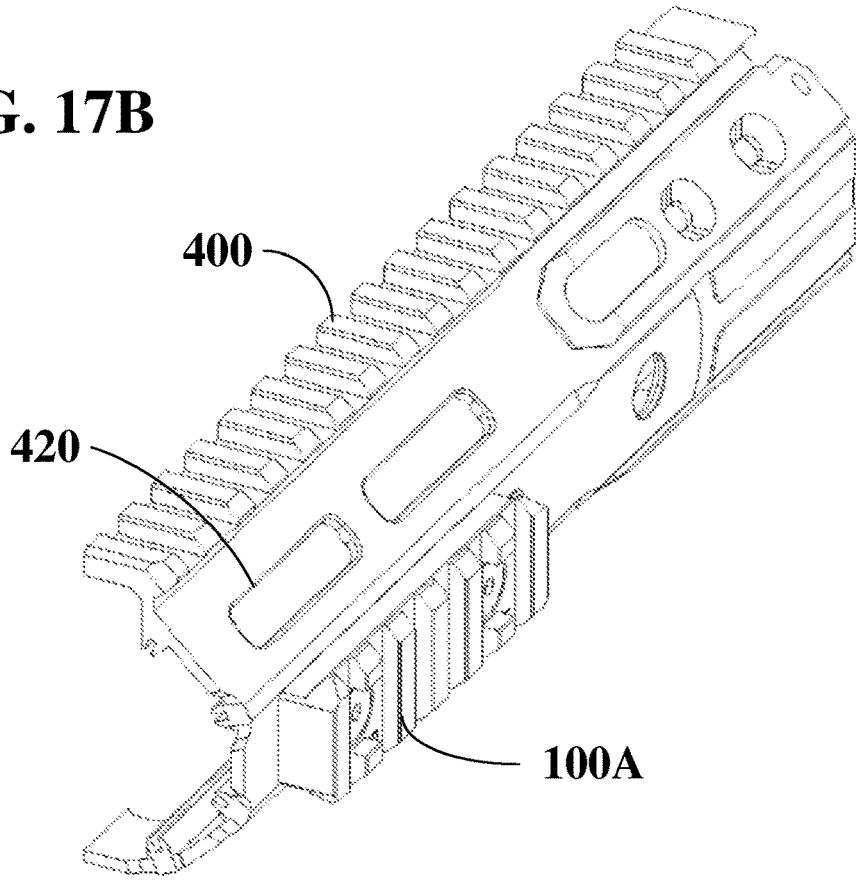

FIG. 17A and FIG. 17B are illustrations of multi-platform accessory rail 100A mounted on handguard 400 having keyhole-shaped openings 410 of the KeyMod handguard rail system or rounded-rectangular openings 420 of the M-LOK handguard rail system in accordance with an implementation of the present disclosure. In each of FIG. 17A and FIG. 17B, multi-platform accessory rail 100A may be mounted on keyhole-shaped openings 410 of the KeyMod handguard rail system and rounded-rectangular openings 420 of the M-LOK handguard rail system, respectively, with the use of fastener screws 350 and pivot fastener nuts 360.

Figure 18:
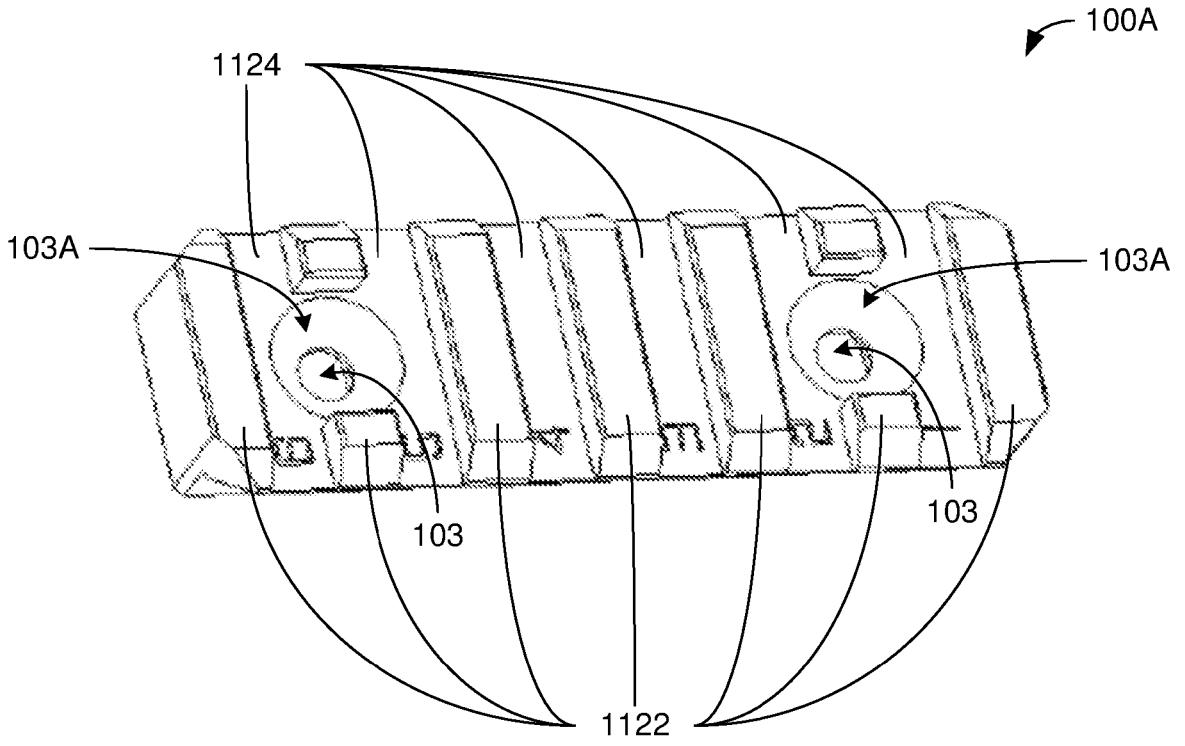
FIG. 18 is an illustration of a top surface and a bottom surface of a multi-platform accessory rail in accordance with an implementation of the present disclosure.
Figure 18:
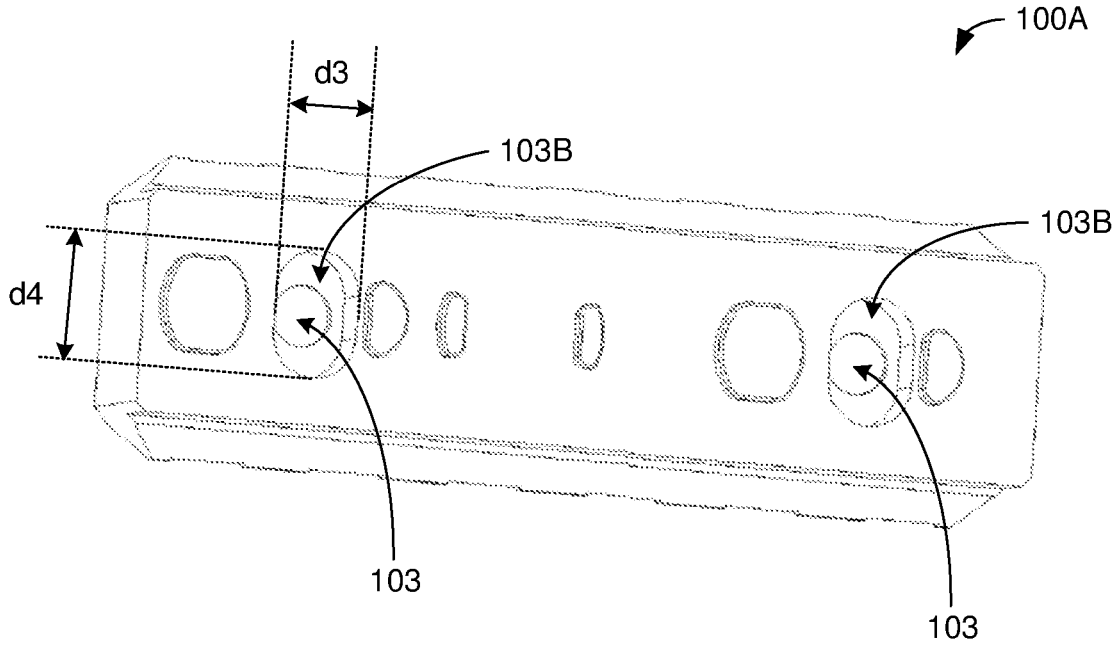

FIG. 18 is an illustration of top surface 112 of multi-platform accessory rail 100A in accordance with an implementation of the present disclosure. Referring to FIG. 18, top surface 112 of multi-platform accessory rail 100A may include a ribbed rail surface with multiple rail ribs 1122 and multiple grooves 1124 separating the rail ribs 1122 from each other. Rail ribs 1122 and grooves 1124 of multi-platform accessory rail 100A may form or otherwise constitute, for example and without limitation, a MIL-STD-1913 rail, a Standardization Agreement 2324 rail, a Picatinny rail, a Weaver rail, a STANAG 4694 rail, or a NATO accessory rail.

Referring to FIG. 18, fastener hole 103 may comprise a combination of larger recess 103B on bottom surface 114 and smaller recess 103A on top surface 112, resulting in a stepwise change in the diameter or width of fastener hole 103 between smaller recess 103A and larger recess 103B. In some embodiments, smaller recess 103A may be generally conical in shape with a gradual and linear change in diameter. This feature allows collar 364 of pivot fastener nut 360 to be seated, accommodated or otherwise received in the larger recess 103B of fastener hole 103. Moreover, the shape of the larger recess 103B of fastener hole 103 is oblong or rounded-rectangular with dimensions d3 and d4 as shown in FIG. 18. Specifically, dimension d3 is less than dimension d1 and greater than dimension d2 of collar 364, and dimension d4 is greater than dimensions d1 and d2 of collar 364. This feature allows collar 364 to turn or rotate in one direction up to 90° when seated, accommodated or otherwise received in the larger recess 103B of fastener hole 103. Thus, as fastener screw 350 is threaded into fastener hole 310 of pivot fastener nut 360, pivot fastener nut 360 is allowed to turn or rotate in one direction up to 90°.

In view of the above, with the user of pivot fastener nuts 360, multi-platform accessory rail 100A can be securely mounted on both keyhole-shaped openings 410 of the KeyMod handguard rail system and rounded-rectangular openings 420 of the M-LOK handguard rail system. It is noteworthy that, although examples and description above with respect to FIG. 10-FIG. 18 are provided in the context of accessory rail, concepts described therein are also applicable to multi-platform ergonomic foregrip 100. That is, multi-platform ergonomic foregrip 100 may also be securely mounted on both keyhole-shaped openings 410 of the KeyMod handguard rail system and rounded-rectangular openings 420 of the M-LOK handguard rail system with the use of pivot fastener nuts 360 and fastener screws 350 in accordance with the present disclosure. In other words, any device attachable to a firearm could benefit from the concepts described herein, and thus the scope and applicability of the present disclosure is not limited to accessory rails and foregrips.

Highlight of Select Features

In one aspect, a detachable foregrip for a firearm may include an attachment surface, a front end, a rear end and a horizontal engagement portion. The attachment surface may be adapted to engage an attachment rail of a handguard of the firearm. The front end may vertically extend from the attachment surface to be substantially perpendicular to the attachment surface. The rear end, located at an opposite side of the front end, may extend downwardly at a predetermined angle from the attachment surface. The horizontal engagement portion may be underneath the attachment surface and extending between the front end and the rear end. The rear end may include: (1) a first engagement surface having a first angled grip surface extending inwardly and downwardly at a predetermined angle from the attachment surface, and (2) a second angled grip surface connecting with the first angled grip surface at an angle over ninety degrees. One end of the horizontal engagement portion may connect to an inner vertical surface. Another end of the horizontal engagement portion may connect to a curved engagement portion. A substantially triangular opening may be formed between the attachment surface, the rear end and the curved engagement portion. A first side of the triangular opening may be substantially parallel to the attachment surface. A second side of the triangular opening may be substantially parallel to the first angled grip surface. A third side of the triangular opening may be substantially parallel to the curved engagement portion.

In some implementations, the detachable foregrip may also include a plurality of lugs on the attachment surface. The lugs may provide a means for operably positioning the foregrip to the attachment rail.

In some implementations, the front end may form a vertical hand engagement portion.

In one aspect, a detachable firearm attachment implementable on a firearm may include a main body and a fastening device. The main body may have a first primary side and a second primary side. The first primary side may be configured to attach to both a first handguard rail system of a first handguard of the firearm and a second handguard rail system of a second handguard of the firearm. The fastening device may be configured to fasten the main body to the first handguard and the second handguard. The first handguard may include a plurality of first openings of a first shape with first dimensions. The second handguard may include a plurality of second openings of a second shape with second dimensions. The first shape and the second shape may be different. The first dimensions and the second dimensions may be different.

In some implementations, the first handguard rail system may include a KeyMod handguard rail system, and the second handguard rail system may include an M-LOK handguard rail system.

In some implementations, the fastening device may include at least a fastener screw and at least a pivot fastener nut. The pivot fastener nut may have a threaded fastener through hole configured to mate with threads of the fastener screw. The main body may include at least a fastener hole communicatively connecting the first primary side and the second primary side of the main body. The fastening device may fasten the main body to the first handguard by fastening main body and the first handguard between the fastener screw and the pivot fastener nut, with the fastener screws traversing through the fastener hole of the main body and one of the first openings of the first handguard. The fastening device may fasten the main body to the second handguard by fastening main body and the second handguard between the fastener screw and the pivot fastener nut, with the fastener screws traversing through the fastener hole of the main body and one of the second openings of the second handguard.

In some implementations, the fastener hole may include a first recess on the first primary side of the main body and a second recess on the second primary side of the main body. A first size of the first recess and a second size of the second recess may be different. A first shape of the first recess and a second shape of the second recess may be different.

In some implementations, the pivot fastener nut may include a pivot wing and a collar. When the fastening device fastens the main body to either the first handguard or the second handguard, a cap of the fastener screw may be received in the second recess of the fastener hole and the collar of the pivot fastener nut may be received in the first recess of the fastener hole.

In some implementations, physical features of the pivot wing may be configured such that: (1) when inserting at least the pivot wing of the pivot fastener nut through the one of the first openings to fasten the main body to the first handguard, a longitudinal axis of the pivot wing is parallel to a longitudinal axis of the main body, and (2) when inserting at least the pivot wing of the pivot fastener nut through the one of the second openings to fasten the main body to the second handguard, the longitudinal axis of the pivot wing is parallel to the longitudinal axis of the main body.

In some implementations, physical features of the collar may be configured such that: (1) when the fastener screw is tightened in the threaded fastener through hole of the pivot fastener nut to fasten the main body to the first handguard, the longitudinal axis of the pivot wing is parallel to a longitudinal axis of the main body, and (2) when the fastener screw is tightened in the threaded fastener through hole of the pivot fastener nut to fasten the main body to the second handguard, the longitudinal axis of the pivot wing is perpendicular to the longitudinal axis of the main body.

In some implementations, a shape of the collar may generally resemble a rhombus when viewed in a direction along a longitudinal axis of the threaded fastener through hole.

In some implementations, a first dimension between two opposing corners of the rhombus with an acute angle may be greater than a second dimension between two opposing corners of the rhombus with an obtuse angle. Moreover, a shape of the first recess may generally resemble a rounded rectangle, with a length of the rounded rectangle greater than a width of the rounded rectangle.

In some implementations, the width of the rounded rectangle may be greater than the second dimension of the rhombus and less than the first dimension of the rhombus such that the pivot fastener nut is allowed to rotate in one direction up to 90° when received in the first recess.

In some implementations, the main body may also include an array of alignment lugs protruding from the second primary side of the main body. The alignment lungs may be spaced apart such that at least two of the alignment lugs are adjacent to a rim of two distal ends of two of the first openings or two of the second openings when the main body is fastened to the first handguard or the second handguard, respectively.

In some implementations, at least a first alignment lug and a second alignment lug of the plurality of alignment lugs may be of different sizes or different shapes.

In some implementations, the detachable attachment may include an accessory rail. In such cases, the second primary side may include a ribbed rail surface having a plurality of rail ribs and a plurality of grooves each between respective two adjacent rail ribs of the plurality of rail ribs. The ribbed rail surface may be configured to accept attachment of one or more firearm accessories.

In some implementations, the ribbed rail surface may form a MIL-STD-1913 rail, a Standardization Agreement 2324 rail, a Picatinny rail, a Weaver rail, a STANAG 4694 rail, or a NATO accessory rail.

Alternatively, the detachable attachment may include a foregrip. The foregrip may include: (1) an attachment surface on the first primary side and adapted to engage an attachment rail of a handguard of the firearm; (2) a front end vertically extending from the second primary side to be substantially perpendicular to the attachment surface; (3) a rear end, located at an opposite side of the front end, extending downwardly at a predetermined angle from the second primary side; and (4) a horizontal engagement portion underneath the attachment surface and extending between the front end and the rear end. The rear end may include a first engagement surface having a first angled grip surface extending inwardly and downwardly at a predetermined angle from the attachment surface and a second angled grip surface connecting with the first angled grip surface at an angle over ninety degrees. One end of the horizontal engagement portion may connect to an inner vertical surface. Another end of the horizontal engagement portion may connect to a curved engagement portion. A substantially triangular opening may be formed between the attachment surface, the rear end and the curved engagement portion. A first side of the triangular opening may be substantially parallel to the attachment surface. A second side of the triangular opening may be substantially parallel to the first angled grip surface. A third side of the triangular opening may be substantially parallel to the curved engagement portion.

In some implementations, the detachable firearm attachment, as a foregrip, may also include a plurality of lugs on the attachment surface to provide a means for operably positioning the foregrip to the attachment rail.

In some implementations, the front end may form a vertical hand engagement portion.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A detachable firearm attachment implementable on a firearm, comprising:

a main body having a first primary side and a second primary side, the first primary side configured to attach to holes of a first handguard rail system of a first handguard of the firearm and holes of a second handguard rail system of a second handguard of the firearm with the holes of the first handguard having a first shape and first dimensions and the holes of the second handguard having a second shape and second dimensions, wherein the first shape and the second shape are different, and wherein the first dimensions and the second dimensions are different; and a fastening device with physical features such that, when the main body is attached to the firearm, the fastening device is configured to fasten the main body to the holes of the first handguard and to the holes of the second handguard, wherein the first handguard rail system comprises a plurality of key-hole shaped slots, wherein the second handguard rail system comprises a plurality of rounded-square slots, wherein the detachable attachment comprises an accessory rail, wherein the second primary side comprises a ribbed rail surface comprising a plurality of rail ribs and a plurality of grooves each between respective two adjacent rail ribs of the plurality of rail ribs, and wherein the ribbed rail surface is configured to accept attachment of one or more firearm accessories.

2. The detachable firearm attachment of claim 1, wherein the fastening device comprises:

at least a fastener screw; and at least a pivot fastener nut having a threaded fastener through hole configured to mate with threads of the fastener screw, wherein the main body comprises at least a fastener hole communicatively connecting the first primary side and the second primary side of the main body, wherein the fastening device is configured to fasten the main body to the first handguard by fastening main body and the first handguard between the fastener screw and the pivot fastener nut, with the fastener screws traversing through the fastener hole of the main body and one of the holes of the first handguard, and wherein the fastening device is configured to fasten the main body to the second handguard by fastening main body and the second handguard between the fastener screw and the pivot fastener nut, with the fastener screws traversing through the fastener hole of the main body and one of the holes of the second handguard.

3. The detachable firearm attachment of claim 2, wherein the fastener hole comprises a first recess on the first primary side of the main body and a second recess on the second primary side of the main body, wherein a first size of the first recess and a second size of the second recess are different, and wherein a first shape of the first recess and a second shape of the second recess are different.

4. The detachable firearm attachment of claim 3, wherein the pivot fastener nut comprises:

a pivot wing; and a collar, wherein, when the fastening device fastens the main body to either the first handguard or the second handguard, a cap of the fastener screw is received in the second recess of the fastener hole and the collar of the pivot fastener nut is received in the first recess of the fastener hole.

5. The detachable firearm attachment of claim 4, wherein physical features of the pivot wing are configured such that:

when inserting at least the pivot wing of the pivot fastener nut through the one of the holes of the first handguard to fasten the main body to the first handguard, a longitudinal axis of the pivot wing is parallel to a longitudinal axis of the main body, and when inserting at least the pivot wing of the pivot fastener nut through the one of the holes of the second handguard to fasten the main body to the second handguard, the longitudinal axis of the pivot wing is parallel to the longitudinal axis of the main body.

6. The detachable firearm attachment of claim 5, wherein physical features of the collar are configured such that:

when the fastener screw is tightened in the threaded fastener through hole of the pivot fastener nut to fasten the main body to the first handguard, the longitudinal axis of the pivot wing is parallel to a longitudinal axis of the main body, and when the fastener screw is tightened in the threaded fastener through hole of the pivot fastener nut to fasten the main body to the second handguard, the longitudinal axis of the pivot wing is perpendicular to the longitudinal axis of the main body.

7. The detachable firearm attachment of claim 6, wherein a shape of the collar generally resembles a rhombus when viewed in a direction along a longitudinal axis of the threaded fastener through hole.

8. The detachable firearm attachment of claim 7, wherein a first dimension between two opposing corners of the rhombus with an acute angle is greater than a second dimension between two opposing corners of the rhombus with an obtuse angle, wherein a shape of the first recess generally resembles a rounded rectangle, and wherein a length of the rounded rectangle is greater than a width of the rounded rectangle.

9. The detachable firearm attachment of claim 8, wherein the width of the rounded rectangle is greater than the second dimension of the rhombus and less than the first dimension of the rhombus such that the pivot fastener nut is allowed to rotate in one direction up to 90° when received in the first recess.

10. The detachable firearm attachment of claim 4, wherein the main body further comprises an array of alignment lugs protruding from the second primary side of the main body, wherein the alignment lungs are spaced apart such that at least two of the alignment lugs are adjacent to a rim of two distal ends of two of the holes of the first handguard or two of the holes of the second handguard when the main body is fastened to the first handguard or the second handguard, respectively.

11. The detachable firearm attachment of claim 10, wherein at least a first alignment lug and a second alignment lug of the plurality of alignment lugs are of different sizes or different shapes.

12. The detachable firearm attachment of claim 1, wherein the ribbed rail surface forms a MIL-STD-1913 rail, a Standardization Agreement 2324 rail, a Picatinny rail, a Weaver rail, a STANAG 4694 rail, or a NATO accessory rail.

13. The detachable firearm attachment of claim 1, wherein the detachable attachment comprises a foregrip that comprises:

an attachment surface on the first primary side and adapted to engage an attachment rail of a handguard of the firearm;

a front end vertically extending from the second primary side to be substantially perpendicular to the attachment surface;

a rear end, located at an opposite side of the front end, extending downwardly at a predetermined angle from the second primary side; and a horizontal engagement portion underneath the attachment surface and extending between the front end and the rear end, wherein the rear end comprises a first engagement surface having a first angled grip surface extending inwardly and downwardly at a predetermined angle from the attachment surface and a second angled grip surface connecting with the first angled grip surface at an angle over ninety degrees, wherein one end of the horizontal engagement portion connects to an inner vertical surface, wherein another end of the horizontal engagement portion connects to a curved engagement portion, wherein a substantially triangular opening is formed between the attachment surface, the rear end and the curved engagement portion, wherein a first side of the triangular opening is substantially parallel to the attachment surface, wherein a second side of the triangular opening is substantially parallel to the first angled grip surface, and wherein a third side of the triangular opening is substantially parallel to the curved engagement portion.

14. The detachable firearm attachment of claim 13, further comprising:

a plurality of lugs on the attachment surface, wherein the lugs provide a means for operably positioning the foregrip to the attachment rail.

15. The detachable firearm attachment of claim 13, wherein the front end forms a vertical hand engagement portion.

* * * * *